US012703920B2

(12) United States Patent
Sweetland et al.

(10) Patent No.: US 12,703,920 B2
(45) Date of Patent: Aug. 11, 2026

(54) ELECTROLYZER STACK END PLATE ASSEMBLY WITH FLUID-ISOLATING INSERT(S)

(71) Applicant: PLUG POWER INC., Latham, NY (US)

(72) Inventors: Matthew Sweetland, Latham, NY (US); Cortney Mittelsteadt, Latham, NY (US)

(73) Assignee: Plug Power Inc., Latham, NY (US)

( * ) Notice: Subject to any disclaimer, the term of this patent is extended or adjusted under 35 U.S.C. 154(b) by 722 days.

(21) Appl. No.: 18/170,006

(22) Filed: Feb. 16, 2023

(65) Prior Publication Data

US 2024/0279819 A1 Aug. 22, 2024

(51) Int. Cl.
*C25B 1/04* (2021.01)
*C25B 9/73* (2021.01)

(52) U.S. Cl.
CPC . *C25B 1/04* (2013.01); *C25B 9/73* (2021.01)

(58) Field of Classification Search
CPC ..... C25B 1/04–044
See application file for complete search history.

(56) References Cited

U.S. PATENT DOCUMENTS 1,508,758 A * 9/1924 Allan ..... C25B 9/77 204/256
4,371,433 A 2/1983 Balko et al.
5,912,088 A 6/1999 Ernst
6,322,920 B1 11/2001 Tomson
6,669,826 B1 12/2003 Milgate, Jr. et al.
6,685,821 B2 2/2004 Kosek et al.
6,787,258 B2 9/2004 Prerad
6,852,441 B2 2/2005 Milgate, Jr. et al.
7,229,534 B2 6/2007 LaConti et al.
8,182,659 B2 5/2012 LaConti et al.
8,282,811 B2 10/2012 Kosek et al.
2006/0040159 A1 2/2006 Sato et al.
2022/0243339 A1 8/2022 Yang et al.
2022/0243344 A1 8/2022 Yang et al.
2023/0028509 A1 1/2023 Rouveyre et al.

OTHER PUBLICATIONS

European Search Report dated Aug. 29, 2024, based on European Patent Application No. 24157387.2, 8 pages.

* cited by examiner

*Primary Examiner* — Hosung Chung
(74) *Attorney, Agent, or Firm* — Victor Cardona, Esq; Heslin Rothenberg Farley & Mesiti P.C.

(57) ABSTRACT

Electrolyzer systems and end plate assemblies are provided with one or more fluid-isolating inserts. The electrolyzer system includes a stack of electrolyzer cells, a current collector, an end plate assembly, and an isolation plate positioned between the end plate assembly and current collector. The end plate assembly includes at least one fluid channel to allow fluid to pass therethrough, where the fluid channel(s) is in fluid communication with at least one fluid channel through the current collector and isolation plate. The end plate assembly includes an end plate and an fluid-isolating insert residing, at least in part, within a pocket in the end plate. The fluid-isolating insert includes at least one electrically-isolating fluid channel that defines, at least in part, the fluid channel(s) of the end plate assembly, where the fluid-isolating insert increases an effective length of a fluid conduction path between the current collector and the end plate.

11 Claims, 10 Drawing Sheets

ELECTROLYZER STACK END PLATE ASSEMBLY WITH FLUID-ISOLATING INSERT(S)

BACKGROUND

The present invention relates generally to electrolyzer systems, and more particularly to novel end plate assemblies for one or more electrolyzer stacks of an electrolyzer system.

The drive for renewable energy solutions has resulted in substantial investments into water electrolysis or electrolyzer technologies. It is estimated that the electrolyzer market could increase to 300 GW over the next few decades, and power-to-gas is poised to become a multi-billion dollar market for on-site electrolyzer systems. Electrolyzers use DC electricity to split water into hydrogen and oxygen. As one example, a proton electron membrane (PEM) electrolysis cell is a device which produces hydrogen and oxygen gas using DC electricity to electrochemically split water. A PEM cell contains an active area in which the presence of catalyst permits the reactions to take place. In the electrolysis cell, water enters the anode and is split into protons, electrons, and oxygen gas. The protons are conducted through the membrane, while the electrons pass through the electrical circuit. At the cathode, the protons and electrons recombine to form hydrogen gas.

Often, a number of electrolysis cells are assembled together in order to meet production requirements. One common type of assembly is a stack which includes a plurality of stacked electrolysis cells that are electrically connected in-series, such as in a bipolar configuration.

SUMMARY

Certain shortcomings of the prior art are overcome, and additional advantages are provided herein through the provision of an electrolyzer system which includes a stack of at least one electrolyzer cell, for instance, for generating hydrogen from water. The stack includes a current collector of the at least one electrolyzer cell, an end plate assembly, and an isolation plate. The isolation plate is positioned between the end plate assembly and the current collector to electrically isolate the current collector from the end plate assembly. The end plate assembly includes at least one fluid channel to allow fluid to pass through the end plate assembly, where the at least one fluid channel is in fluid communication with at least one fluid channel through the current collector and the isolation plate. The end plate assembly includes an end plate and a fluid-isolating insert residing, at least in part, within a pocket in the end plate. The fluid-isolating insert includes at least one electrically-isolating fluid channel that defines, at least in part, the at least one fluid channel of the end plate assembly, where the fluid-isolating insert increases an effective length of a fluid conduction path between the current collector and the end plate through the at least one fluid channel of the end plate assembly.

In one embodiment, the pocket in the end plate extends into the end plate from a surface of the end plate closest to the isolation plate. Further, in one or more implementations, a seal is disposed, in part, within a groove in one of the isolation plate or the fluid-isolating insert at an interface of the isolation plate and fluid-isolating insert within the stack.

In one or more embodiments, a gap exists in the pocket between the fluid-isolating insert and the end plate, and the fluid fills the gap between the fluid-isolating insert and the end plate, which facilitates pressure-balancing opposite sides of the seal.

In one or more other embodiments, a pressure-containment seal is disposed between the fluid-isolating insert and the end plate of the end plate assembly.

In one or more further embodiments, a conductive insert is disposed between the fluid-isolating insert and the end plate within the pocket, where the conductive insert defines, in part, the at least one fluid channel of the end plate assembly. In one implementation, the conductive insert includes a platinum material which causes a localized electrolysis reaction at the conductive insert within the at least one channel of the end plate assembly.

In a further embodiment, the end plate assembly includes a plurality of fluid channels and a manifold to allow the fluid to pass through the end plate assembly via the manifold of the end plate assembly. The plurality of fluid channels of the end plate assembly are in fluid communication with a plurality of fluid channels through the current collector and the isolation plate. The fluid-isolating insert includes a plurality of electrically-isolating fluid channels that define, at least in part, the plurality of fluid channels of the end plate assembly. The fluid-isolating insert increases effective length of fluid conduction paths between the current collector and the end plate through the plurality of fluid channels of the end plate assembly.

In one embodiment, the end plate facilitates supplying a clamping force to the electrolyzer stack, and the fluid-isolating insert satisfies pressure-containment restrictions within the electrolyzer stack.

In another embodiment, an end plate assembly for an electrolyzer stack is provided. The end plate assembly includes an end plate to facilitate supplying a clamping force the electrolyzer stack, and a fluid-isolating insert residing, at least in part, within a pocket in the end plate. The fluid-isolating insert includes at least one electrically-isolating fluid channel that defines, at least in part, at least one fluid channel of the end plate assembly, and the fluid-isolating insert increases an effective length of a fluid conduction path within the end plate assembly.

In a further embodiment, an end plate assembly for an electrolyzer stack is provided, which includes an end plate to facilitate supplying a clamping force to the electrolyzer stack, an anode-fluid-isolating insert, and a cathode-fluid-isolating insert. The anode-fluid-isolating insert resides, at least in part, within a pocket in the end plate, and includes at least one electrically-isolating anode fluid channel that defines, at least in part, at least one anode fluid channel of the end plate assembly, where the anode-fluid-isolating insert increases an effective length of an anode fluid conduction path within the end plate assembly. The cathode-fluid-isolating insert resides, at least in part, within another pocket in the end plate, and includes at least one electrically-isolating cathode fluid channel that defines, at least in part, at least one cathode fluid channel of the end plate assembly, where the cathode-fluid-isolating insert increases an effective length of a cathode fluid conduction path within the end plate assembly.

Additional features and advantages are realized through the techniques described herein. Other embodiments and aspects are described in detail herein and are considered a part of the claimed aspects.

BRIEF DESCRIPTION OF THE DRAWINGS

One or more aspects are particularly pointed out and distinctly claimed as examples in the claims at the conclusion of the specification. The foregoing and objects, features, and advantages of one or more aspects are apparent from the following detailed description taken in conjunction with the accompanying drawings in which:

DETAILED DESCRIPTION

Figure 1:
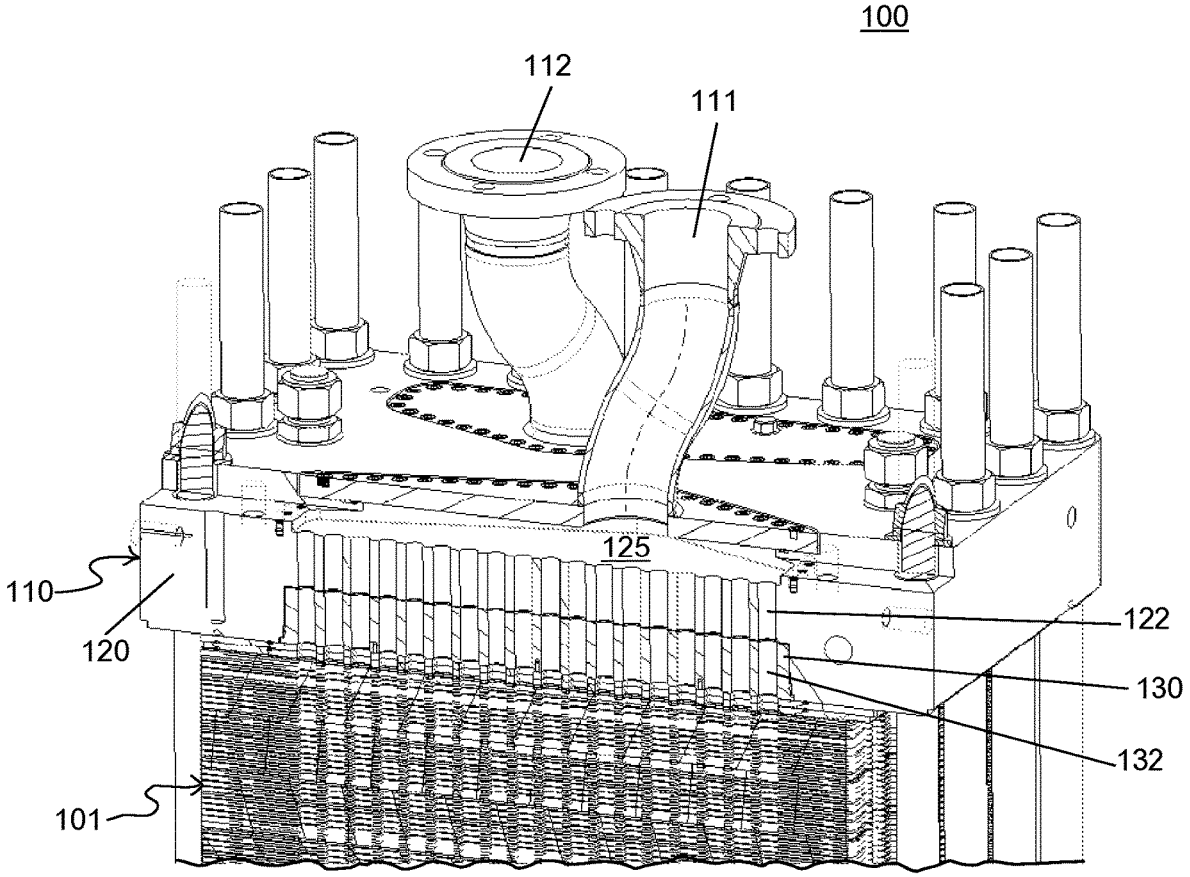
FIG. 1 is a partial cross-sectional view of one embodiment of an electrolyzer stack of an electrolyzer system, in accordance with one or more aspects of the present invention.

The accompanying figures, which are incorporated in and form a part of this specification, further illustrate the present invention and, together with this detailed description of the invention, serve to explain aspects of the present invention. Note in this regard that descriptions of well-known systems, devices, processing techniques, etc., are omitted so as to not unnecessarily obscure the invention in detail. It should be understood, however, that the detailed description and this specific example(s), while indicating aspects of the invention, are given by way of illustration only, and not limitation. Various substitutions, modifications, additions, and/or other arrangements, within the spirit or scope of the underlying inventive concepts will be apparent to those skilled in the art from this disclosure. Note further that numerous inventive aspects or features are disclosed herein, and unless inconsistent, each disclosed aspect or feature is combinable with any other disclosed aspect or feature as desired for a particular application of the concepts disclosed.

As discussed, the push for renewable energy sources and systems has driven substantial investments in water-electrolysis, or electrolyzer technologies. Electrolyzers use DC electricity to split water into hydrogen and oxygen. As an example, a proton electron membrane (PEM) electrolysis cell is a device which produces hydrogen and oxygen using DC electricity to electrochemically split water. A PEM cell contains an active area in which the presence of a catalyst permits the reactions to take place. In the electrolysis cell, water enters the anode and is split into protons, electrons, and oxygen gas. The protons are conducted through the membrane, while the electrons pass through the electrical circuit. At the cathode, the protons and electrons recombine to form hydrogen gas.

Depending on the implementations, a number of electrolysis cells can be assembled together in order to meet hydrogen or oxygen production requirements. One common type of assembly is a stack which includes a plurality of stacked electrolysis cells that are electrically connected in-series, for instance, in a bipolar configuration. The cells of an electrolysis stack are typically compressed between spring-loaded, upper and lower rigid end plates. In order to ensure optimal conversion of water to hydrogen and oxygen by each electrolysis cell in the stack, uniform current distribution across the active areas of the electrodes of each cell is desired. This uniform current distribution requires uniform contact pressure over the active areas of the electrode, which is facilitated by providing the spring-loaded compression between the upper and lower end plates of the stack.

Various sizes of electrolyzer stacks can be produced. For instance, in one embodiment, an electrolyzer stack can include up to 100 or more electrolysis cells arranged in-series in a bipolar configuration. Further, in one or more implementations, voltage across the electrolyzer stack can vary in operation between 200-300 volts, in one example. An electrolyzer system can be provided by connecting in-series multiple electrolyzer stacks and providing a common set of fluid supply and return manifolds to the stacks. For instance, with an electrolyzer system having 5 electrolyzer stacks connected in-series, the voltage across the individual stacks can range from 0 volts at starting to 1500 volts in operation, that is, in the noted 300 volt stack example. Further, depending on the implementation, the electrolyzer system can include one or more sets of series-connected electrolyzer stacks to generate a desired amount of hydrogen and/or oxygen. With such high-voltage electrolyzer systems, shunt-to-ground fluid currents through the anode and cathode ports of an electrolyzer stack within the system can potentially cause performance issues, as well as result in localized corrosion of stack components over time.

For instance, shunt currents through the anode and/or cathode ports can cause electrolyzer system performance and safety issues, as well as result in localized corrosion of electrolyzer stack components. Shunt current can be dependent on, for instance, water quality, port size, insulator plate thickness, and/or secondary fluid contaminants. The end plates are typically formed as rigid metal plate structures, such as stainless steel plates, which perform well when applying compressive pressure to the electrolyzer stack. One approach to reducing shunt currents through the anode and/or cathode ports of an electrolyzer stack is to increase thickness of the primary isolation plates or layers positioned adjacent to the upper and lower end plates. However, aside from increasing the overall height of the stack, this approach has inherent limits due to costs, material availability, and pressure-containment restrictions.

Disclosed herein, in one or more embodiments, are assemblies which significantly increase the effective isolation distance between, for instance, a collector plate and end plate in an electrolyzer stack, in order to increase effective length of a fluid-supported, electrical conduction path between the current collector and the end plate material (e.g., conductive material), and thereby, decrease shunt currents within the electrolyzer stack. These assemblies are especially significant for electrolyzer stacks placed in-series and operated at high voltage, such as in the case of the 1500 volt DC example noted.

In one or more embodiments, disclosed herein is an end plate assembly for an electrolyzer stack of an electrolyzer system to, for instance, generate hydrogen from water. The end plate assembly includes an end plate configured to facilitate supplying a clamping force to the electrolyzer stack, and a fluid-isolating insert residing, at least in part, within a pocket formed in the end plate. The fluid-isolating insert includes at least one electrically-isolating fluid channel that defines, at least in part, at least one fluid channel of the end plate assembly. The fluid-isolating insert is configured to increase an effective length of a fluid conduction path (i.e., a fluid-supported electrical conduction path) between, for instance, a current collector of the electrolyzer stack and the end plate. Advantageously, using one or more fluid-isolating inserts in association with the end plate to form an end plate assembly such as disclosed herein can increase the effective isolation length of fluid conduction paths within the end plate assembly by factors of, for instance, 4 to 8 times, or more, without high material costs or loss of pressure integrity.

By way of example, FIG. 1 depicts one embodiment of an electrolyzer stack 100 of an electrolyzer system, which as noted, can include multiple electrolyzer stacks electrically connected in-series. FIG. 1 illustrates a partial flow path for main anode fluid (e.g., water) through the electrolyzer stack, where an end plate assembly 110 is provided, which includes an anode fluid manifold 125 in fluid communication with an anode fluid outlet 111. In addition to anode fluid manifold 125, end plate assembly 120 includes one or more fluid channels 122 to facilitate the return of anode fluid from a plurality of electrolyzer cells 101. Note that a similar manifold and fluid flow subsystem can be provided within end plate assembly 110 in fluid communication with an anode fluid inlet 112 of the electrolyzer stack to facilitate the supply of anode fluid from the plurality of electrolyzer cells.

In the depicted embodiment, end plate assembly 110 includes an end plate 120 and an anode-fluid-isolating insert 130 (or, more generally, a fluid-isolating insert). End plate 120 is formed of a metal (or metal alloy or other conductive material) and is configured with sufficient size and rigidity to facilitate applying and sustaining the desired clamping force to the electrolyzer stack, which as illustrated, can include a plurality of electrolyzer cells 101, with the number of electrolyzer cells being dependent on the desired electrolyzer stack output.

In accordance with one or more aspects of the present invention, anode-fluid-isolating insert 130 is provided with one or more electrically-isolating anode fluid channels 132 (i.e., anode fluid channels) that define, at least in part, the one or more fluid channels 122 of end plate assembly 110. As illustrated, in one embodiment, a pocket or recess is provided in end plate 120 from a surface of the end plate closest to the plurality of electrolyzer cells 101 so that anode-fluid-isolating insert 130 resides (in one or more embodiments) fully within the end plate boundaries and does not increase the overall height of electrolyzer stack 100. In one embodiment, the pocket within end plate 120 is formed to extend into the end plate over the one or more fluid channels through the end plate. In the embodiment of FIG. 1, the pocket within end plate 120 extends into the end plate from a surface of the end plate that interfaces with an isolation plate of the electrolyzer stack.

Figure 2:
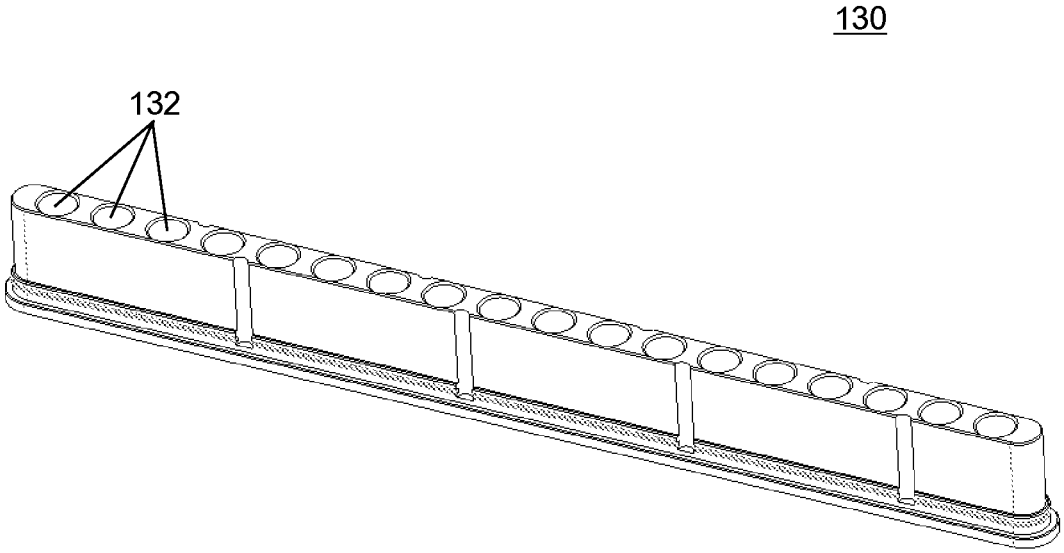
FIG. 2 depicts one embodiment of an anode-fluid-isolating insert of the end plate assembly of FIG. 1, in accordance with one or more aspects of the present invention.

Referring to FIGS. 1 & 2, anode-fluid-isolating insert 130 can be formed by machining, molding, or printing an electrically non-conductive material (such as a polymeric material, rubber, etc.) to form a single monolithic, fluid-isolating insert with a plurality of fluid-isolating channels 132, which are electrically-isolating since the fluid-isolating insert is formed of non-conductive material. By way of specific example, the non-conductive material can be, or include, polyetherimide (PEI-ULTEM), polysulfone, polyetherehterketone (PEEK), polyamide-imide (PAI-Torlon), PTFE, PEN, etc. As noted, in one or more embodiments, anode-fluid-isolating insert 130 is sized and configured to conform to the pocket or recess formed into end plate 120 (see FIG. 1) over the one or more fluid channels in the end plate. Further, note that the number and placement of electrically-isolating fluid channels 132 within the insert depend, for instance, on the number and placement of fluid channels through the current collector and the isolation plate to be coupled in fluid communication to the anode fluid manifold 125 within the end plate assembly 110. Note also that implementation of fluid-isolating inserts such as disclosed herein can be differently configured to increase isolation length dependent on the fluid paths through the electrolyzer stack. Note also that, although depicted herein as a single fluid-isolating insert including multiple fluid-isolating channels, multiple fluid-isolating inserts could be provided for a particular pocket of the end plate, with each fluid-isolating insert being configured with one or more fluid-isolating channels. For instance, in one embodiment, a single insert could have a single fluid-isolating channel as a way of independently isolating each channel.

Figure 3A:
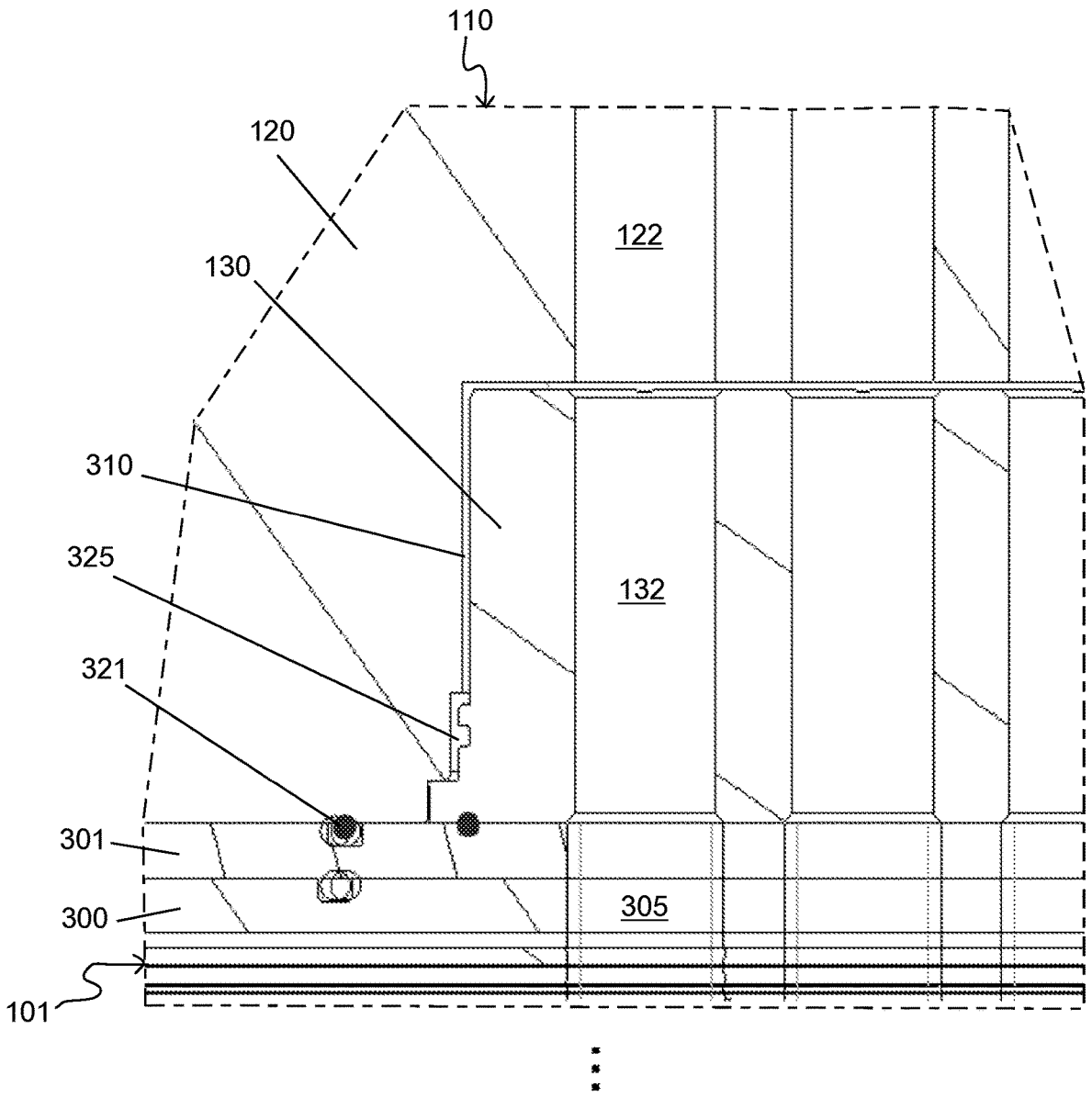
FIGS. 3A-3C depict alternate embodiments of electrolyzer stack end plate assemblies having an anode-fluid-isolating insert within a pocket in the end plate, in accordance with one or more aspects of the present invention.
Figure 3B:
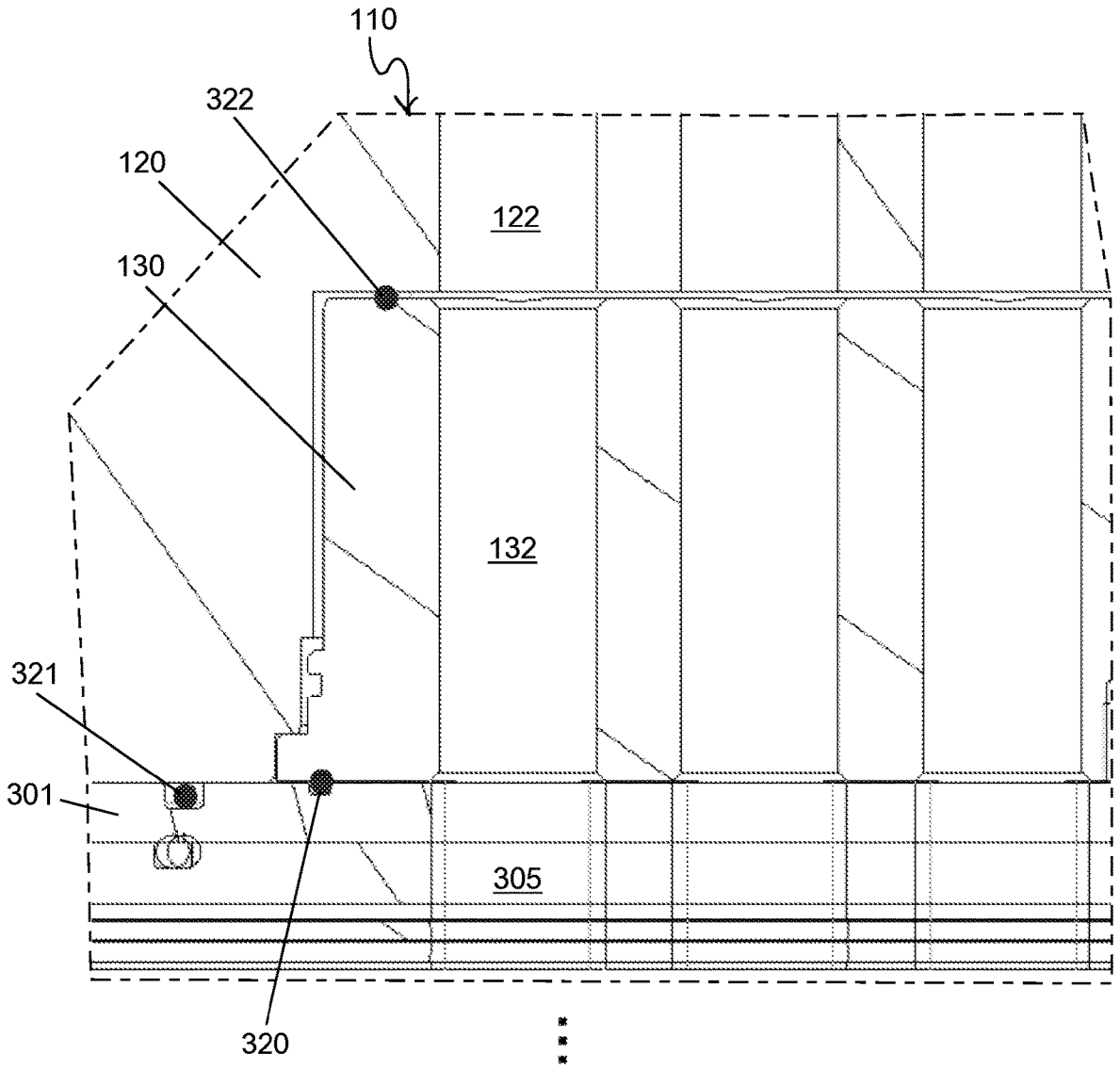
Figure 3C:
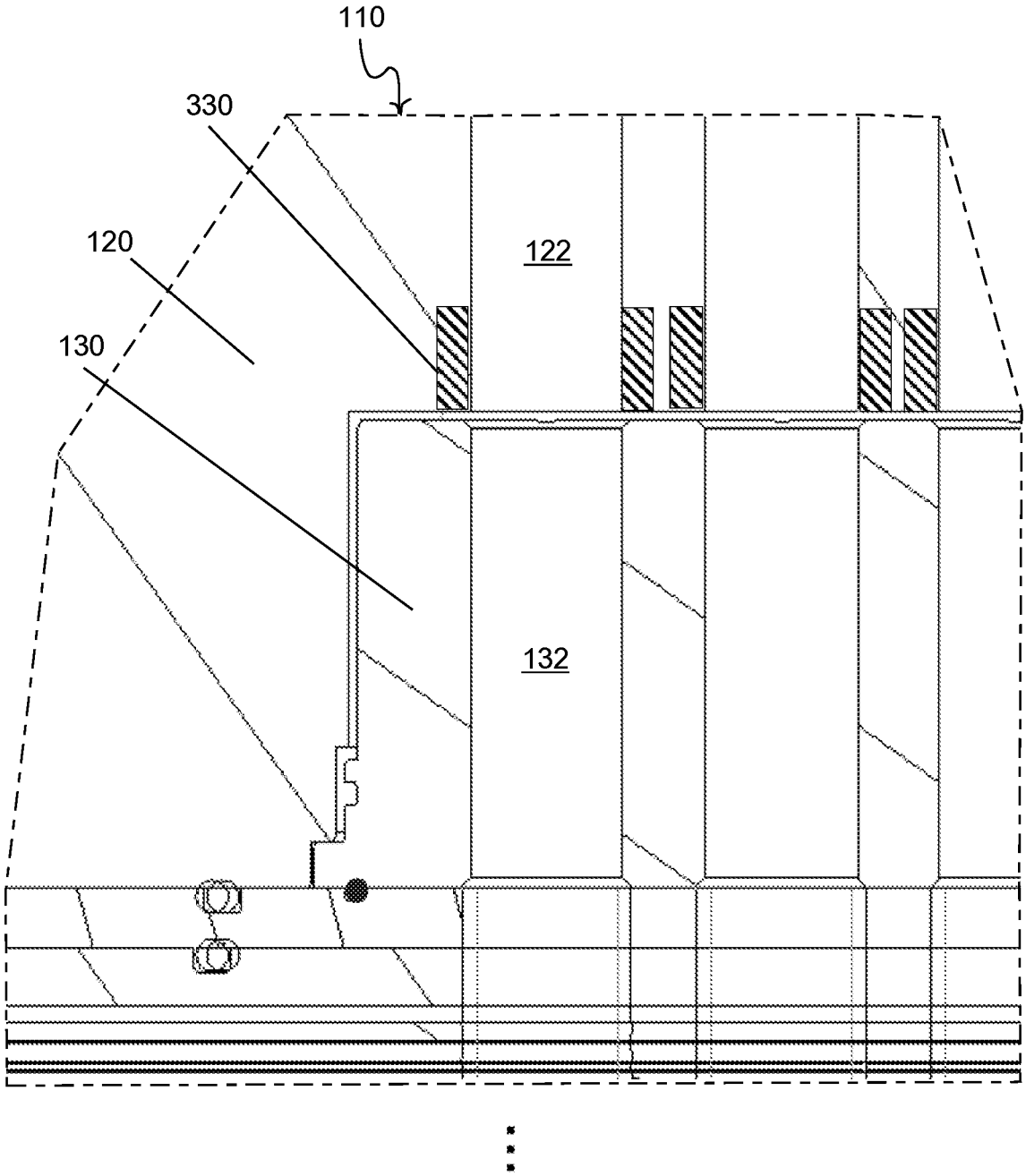

Various approaches to seal anode-fluid-isolating insert 130 to end plate 120 are possible, with FIGS. 3A-3C illustrating three approaches. As noted, a goal in using a fluid-isolating insert is to increase the effective conduction length through the fluid without increasing the overall stack size. By forming (e.g., machining, cutting, molding) one or more pockets into the end plate and matching the pockets with non-conductive, fluid-isolating inserts, the effective conduction length through the different fluid paths of the end plate assembly (e.g., the anode fluid paths and cathode fluid paths) can be increased, such as, for instance, up to a factor of 8 times, or more, the thickness of the standard isolation plate or layer within the electrolyzer stack. This, in turn, can reduce the shunt-to-ground current by a factor of 8 times, or more, depending on the length of the electrically-isolating fluid channels within the fluid-isolating insert.

FIG. 3A depicts an enlarged partial view of a pressure-balancing insert approach, where end plate assembly 110 includes a gap 310 between anode-fluid-isolating insert 130 and end plate 120 that is in fluid communication with one or more fluid channels through the assembly. In the depicted embodiment, the electrolyzer stack includes, in addition to the plurality of electrolyzer cells 101, a current collector 300 of one or more of the electrolyzer cells, and an isolation plate or layer 301 to provide electrical isolation between current collector 300 and end plate assembly 110. Further, in one embodiment, fluid channels 122, 132 of end plate assembly 110 are in fluid communication with respective fluid channels 305 through current collector 300 and isolation plate 301. In this pressure-balancing insert approach, a seal 320, such as a fluidic seal that provides ionic isolation, is disposed, in one example, within a groove in the isolation plate 301 and/or the anode-fluid-isolating insert 130 at an interface of isolation plate 301 and anode-fluid-isolating insert 130 within the stack. Advantageously, in the embodiment of FIG. 3A, fluid fills gap 310 between fluid-isolating insert 130 and end plate 120, and in so doing, fluid pressure on opposite sides of seal 320 tends to balance. In particular, by placing the seal in the short path between the current collector and the end plate, fluid passes over the top of the anode-liquid-isolating insert within the pocket, and down the side of the anode-fluid-isolating insert facing gap 310. This puts substantially the same fluid pressure on both sides of the isolating seal 320, while maintaining full ionic isolation and a longer effective conduction path through the fluid between current collector 300 and end plate 120. Further, by pressure-balancing the insert as described, manufacturing tolerances on the fluid-isolating insert are eased, and thinner wall inserts can be used, allowing use of lower cost and easier production techniques such as injection or compression molding.

In one embodiment, an additional pressure seal 321 can be provided between isolation plate 301 and end plate 120. From a tolerance stack-up viewpoint, however, this is a two-way path seal, rather than a three-way path seal, such as between the anode-fluid-isolating insert, isolation plate, and end plate. This also facilitates manufacturing tolerances on the anode-fluid-isolating insert and enables use of lower cost production techniques, such as injection or compression-molding. Thus, there are two-different types of seals in this embodiment. One seal 320 provides ionic isolation, with relatively little pressure differential across the seal, and the other provides full pressure differential rating between the end plate and isolation plate. The tolerance stack-up for the ionic isolation is more forgiving than the tolerance stack-up for the pressure isolation. In the embodiment illustrated, anode-fluid-isolating insert 130 further includes a groove or notch 325 in the outer side surface of the insert that is in opposing relation to the inner surface of end plate 120 within the formed pocket. This groove 325 can be a circumferential groove configured to accommodate a further seal or gasket designed to establish a friction-fit of anode-fluid-isolating insert 130 within end plate 120 during assembly, which in turn facilitates movement and placement of the assembly over the other components in the electrolyzer stack during stack-up. Note that the seals described herein can be O-ring seals, flat gaskets, form-in-place gaskets (RTV), soft plastic molded seals, etc. For instance, in one embodiment of the pressure-balancing insert approach, the seal could be directly molded as part of the insert.

FIG. 3B depicts an alternate embodiment of end plate assembly 110, where anode-fluid-isolating insert 130 is configured to withstand the full pressure of the fluid within the electrolyzer stack. In this case, seals 320, 322 on the bottom and top of the anode-fluid-isolating insert provide pressure-sealing and ionic path sealing (between the current collector and the end plate about the insert) of the fluid passing through fluid channels 122, 132, 305 of the electrolyzer stack. This implementation can require machining or pocketing of the end plate 120, and precise installation of the seals 320, 322, to allow for the full-pressure rating of the seals (such as for a 15 bar anode port pressure). For instance, one or more grooves can be provided in the isolation plate 301, anode-fluid-isolating insert 130, and/or end plate 120, to accommodate the pressure and ionic seals 320, 322, in one embodiment. In the depicted embodiment, anode-fluid-isolating insert 130 also has sufficient wall thickness about the fluid channels to carry the full anode port pressure load. In addition, this embodiment can include, if desired, the additional pressure-seal 321 between isolation plate 301 and end plate 120.

FIG. 3C depicts a further variation of end plate assembly 110 for an electrolyzer stack, in accordance with one or more aspects of the present invention. This embodiment illustrates a variation of the end plate assembly where the pocket in end plate 120 is further configured to accommodate a conductive insert 330 of a secondary material, such as solid, plated, or porous media, at the top of anode-fluid-isolating insert 130 within the pocket, with the material of conductive insert 330 being selected to facilitate controlling the reaction type that takes place along the fluid channel wall within the assembly at that location. No matter the length of the fluid-isolating insert channels 132, shunt current can pass through the fluid path. This current can lead to corrosion, pitting, dissolution, etc., of end plate 120 material at the end (e.g., top) of the anode-fluid-isolating insert 130 within the pocket. The corrosion in turn can introduce ions into the fluid stream in channels 122, which is disadvantageous for water-conductivity, and can cause localized pitting and corrosion points, which can lead to loss of sealing capability or lowered stress-handling capacity. The conductive insert material is selected to help control the type of reaction occurring within the channels at that location. In particular, the material for conductive insert 330 can be selected to drive the shunt current to cause a localized electrolysis reaction within the channels, which does not affect the end plate material, rather than an electrochemical reaction that may result in a dissolution of metal ions from the end plate into the fluid stream. One example of the conductive material that can be used is platinum. In one embodiment, conductive insert 330 can be coated with platinum to drive the localized electrolysis reaction within the fluid stream. Although illustrated in association with the pressure-balanced, fluid-isolating insert approach of FIG. 3A, it should be noted that the conductive insert 330 of FIG. 3C can also be used in association with the full-pressure-sealing approach of FIG. 3B. Note also that the conductive insert can be mechanically mounted in position any number of ways. For instance, the conductive insert can be press-fit into the end plate, or mechanically fastened to the end plate (e.g., via one or more bolts) in good electrical contact with the end plate.

As noted, FIGS. 1-3C illustrate different embodiments of an anode-fluid-isolating insert that can reside, for instance, within one or two pockets of the end plate to facilitate increasing an effective length of the anode fluid conduction paths within the anode subsystem of the electrolyzer stack end plate. For the main anode fluid supply and return, it is known that both initial low-starting fluid-resistivity, and transitory effects upon startup after extended shutdown can result in water quality approaching, for instance, 1 MΩ·cm, or worse. This can result in high shunt-to-ground currents at startup through the anode fluid supply and return ports. In addition, during initial startup, carbon particles from the cathode cavities can result in localized high conductivity paths along the cathode exit port(s).

An example of a cathode-fluid-isolating insert 400, in accordance with one or more aspects of the present invention, is depicted in FIGS. 4-6C. Cathode-fluid-isolating insert 400 can be, in one or more embodiments, formed of a similar non-conductive material as the anode-fluid-isolating inserts depicted in FIGS. 1-3C. The insert is configured with one or more electrically-isolating fluid channels to increase an effective length of a cathode fluid conduction path between, for instance, the current collector and the end plate through one or more cathode fluid channels within the end plate assembly. Note that unless otherwise specified, the term fluid is used herein to refer to a liquid flow, gas flow, or two-phase flow through the electrolyzer stack, depending on the stage of the process.

Figure 4:
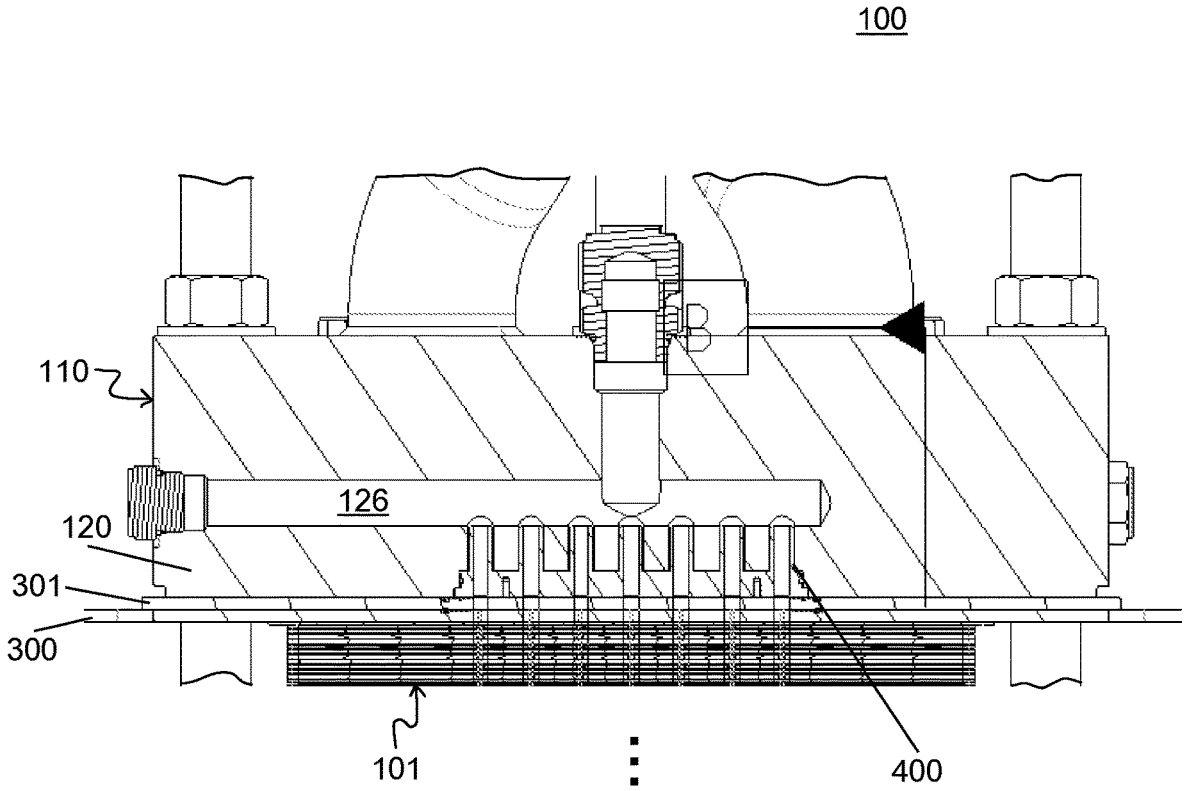
FIG. 4 is a further partial cross-sectional view of the electrolyzer stack of FIG. 1, illustrating one embodiment of a cathode-fluid-isolating insert of the end plate assembly, in accordance with one or more aspects of the present invention.

By way of example, FIG. 4 is a further cross-sectional view of end plate assembly 110, taken through a cathode fluid manifold 126 in communication with a cathode fluid port and a plurality of cathode fluid channels of the end plate assembly, aligned over and in fluid communication with respective fluid channels through current collector 300 and isolation plate 301 for, for instance, removing hydrogen gas from the cathodes of the individual electrolysis cells in the electrolyzer stack. As depicted in FIG. 4, cathode-fluid-isolating insert 400 resides within a respective pocket or recess in end plate 120, formed for instance, from a surface of end plate 120 adjacent to, or in contact with isolation plate 301 of electrolyzer stack 100. Due to the pressure differentials within the electrolyzer stack between the anode fluid subsystem (e.g., 15 bar) and the cathode fluid subsystem (e.g., 45 bar), the cathode-fluid-isolating insert 400 can be, in one or more embodiments, differently configured from the anode-fluid-isolating insert of FIGS. 1-3C.

Figure 5:
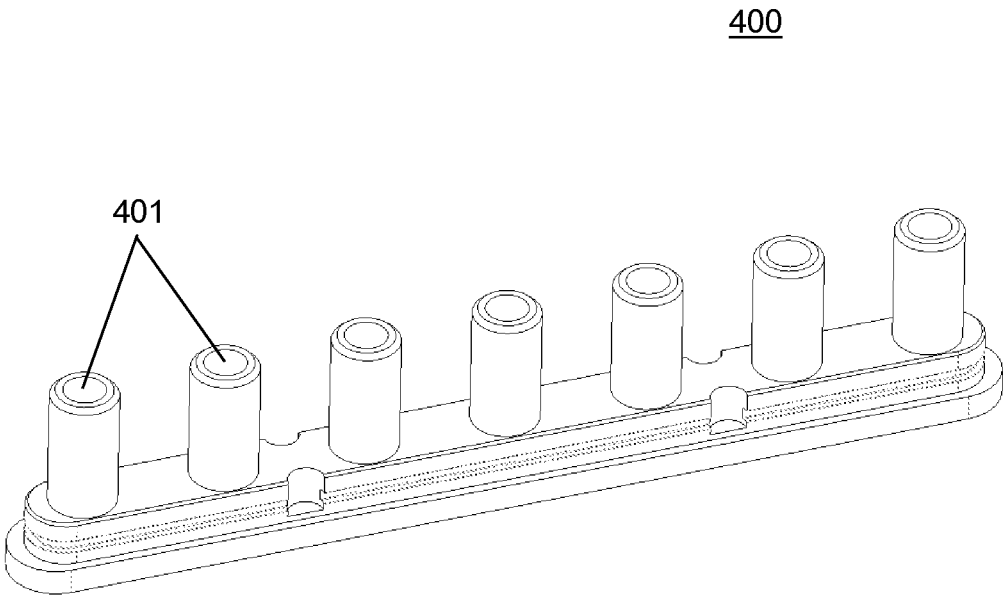
FIG. 5 depicts one embodiment of the cathode-fluid-isolating insert of the electrolyzer stack end plate assembly of FIG. 4.

Referring to FIGS. 4 & 5, in one or more embodiments, a pocket or recess is provided in end plate 120 from a surface of the end plate to reside closest to the plurality of electrolyzer cells 101 within the electrolyzer stack, with the pocket being sized and configured so that cathode-fluid-isolating insert 400 resides within the end plate boundary, and does not increase the overall height of electrolyzer stack 100. In one embodiment, cathode-fluid-isolating insert 400 also has sufficient wall thickness about the fluid channels to carry the full cathode port pressure load. This can be facilitated by forming the cathode-fluid-isolating insert 400 such that its electrically-isolating cathode fluid channels 401 extend into respective openings (e.g., respective cylindrical openings) in the end plate, with the end plate structure providing added pressure support for the resultant end plate assembly.

As noted, in one or more embodiments, cathode-fluid-isolating insert 400 includes one or more electrically-isolating cathode fluid channels 401 (i.e., cathode fluid channels) that define, at least in part, one or more fluid channels of end plate assembly 110. Cathode-fluid-isolating insert 400 can be formed by machining, molding, or printing a non-conductive material to form, in one embodiment, a single monolithic, fluid-isolating insert, or isolator, with (for instance) a plurality of electrically-isolating cathode fluid channels 401 that extend, in one embodiment, from the outer surface of end plate 120 to cathode manifold 126 within the end plate. Note that the number and placement of electrically-isolating cathode fluid channels 401 can be dependent on the number and placement of the respective fluid channels through current collector 300 and isolation plate 301 with which the cathode fluid channels are designed to be in fluid communication.

Figure 6A:
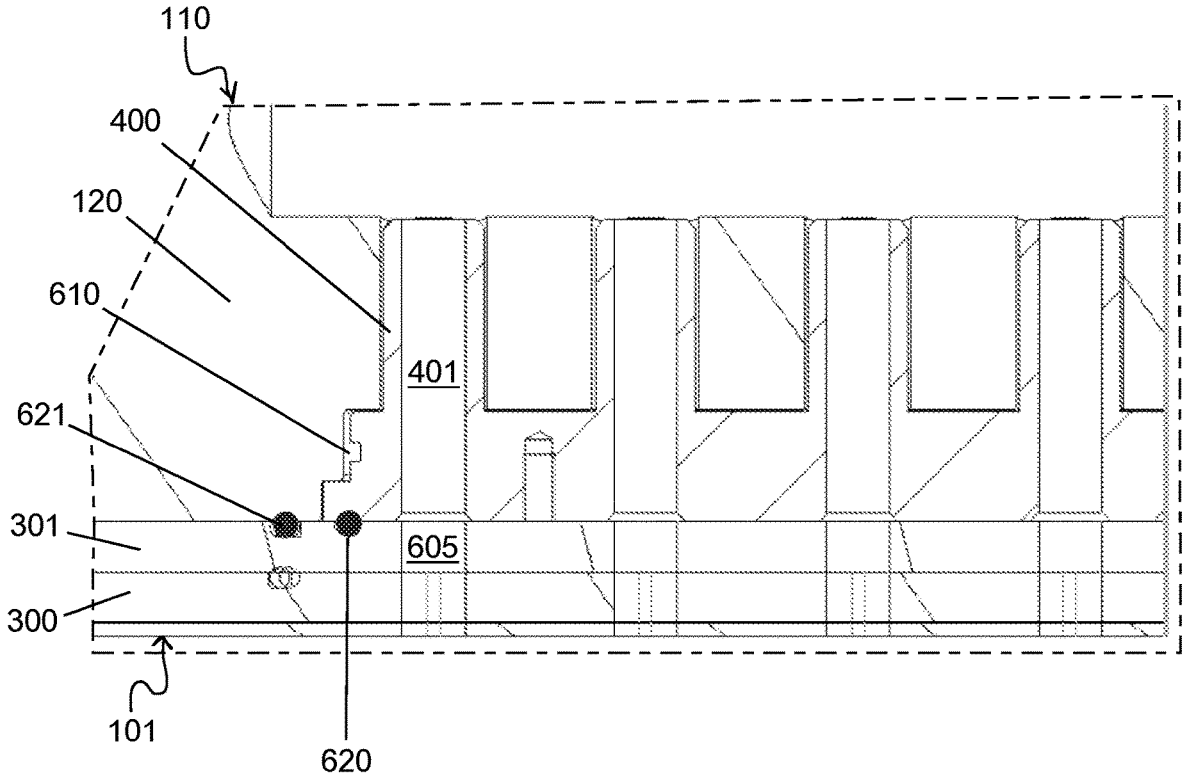
FIGS. 6A-6C depict alternate embodiments of electrolyzer stack end plate assemblies having a cathode-fluid-isolating fluid insert within a pocket in the end plate, in accordance with one or more aspects of the present invention.
Figure 6B:
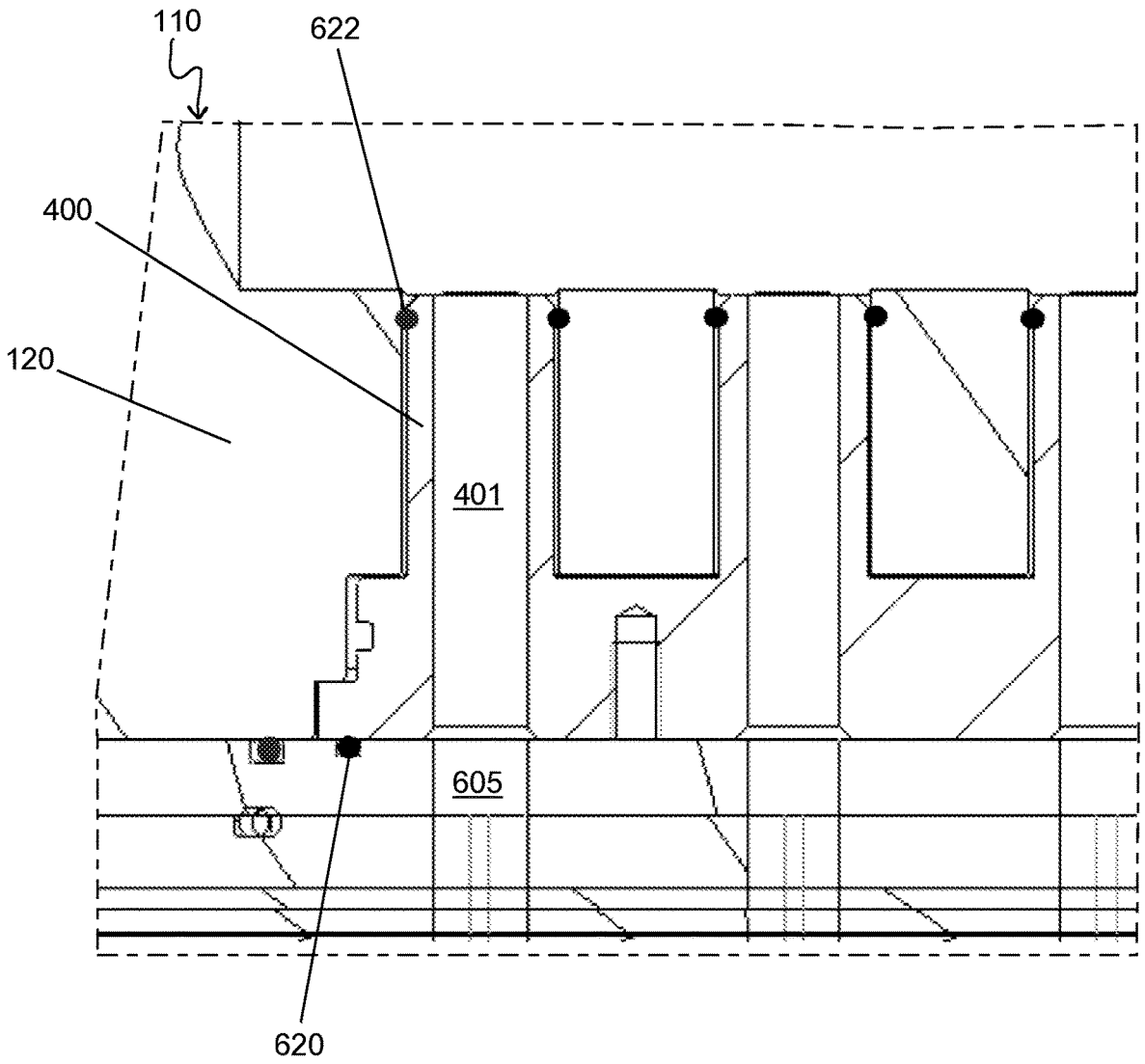
Figure 6C:
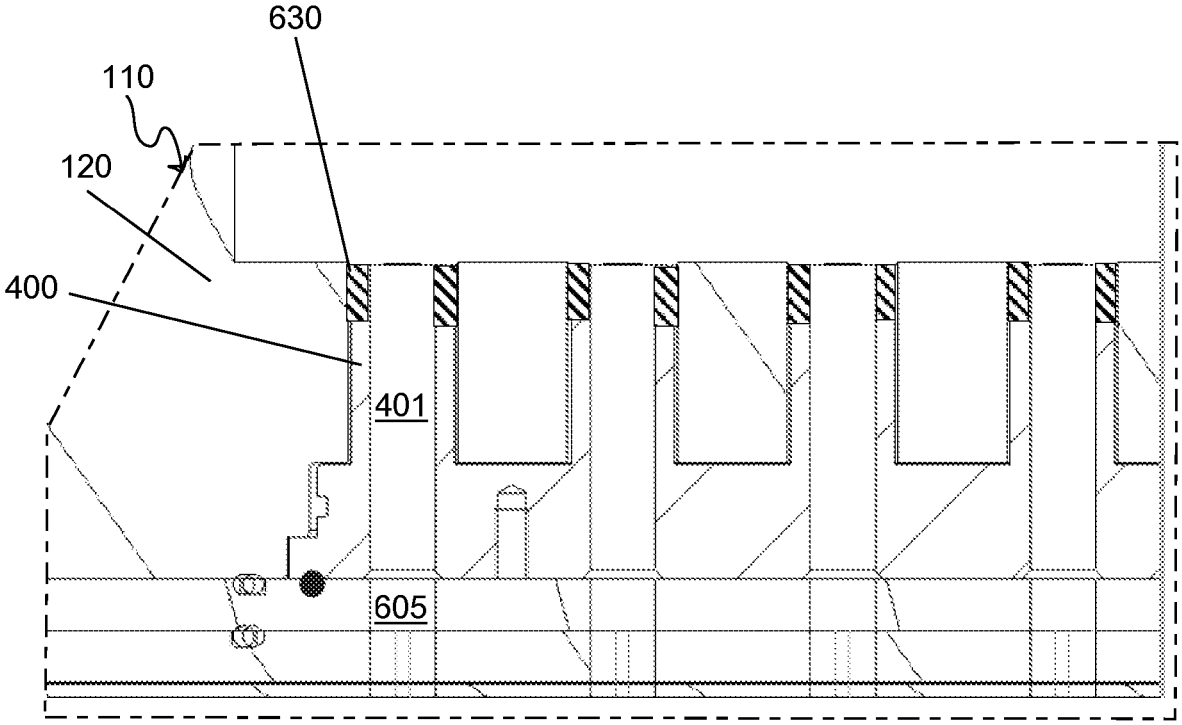

Similar to the embodiments of FIGS. 3A-3C, various approaches for sealing cathode-fluid-isolating insert 400 to end plate 120 are possible, with FIGS. 6A-6C illustrating three approaches, by way of example. As noted, the goal in using a cathode-fluid-isolating insert is to increase the effective conduction length through the cathode fluid, without increasing the overall stack size. By forming (e.g., machining, molding, cutting, etc.) pockets into the end plate, and matching the pockets with non-conductive fluid-isolating inserts, the effective conduction length through the different fluid paths of the end plate assembly (e.g., the anode and/or cathode fluid paths) can be increased, such as, for instance, up to a factor of 8 times, or more, depending on the thickness of the adjacent isolation plate or layer within the electrolyzer stack, and the thickness of the end plate. This, in turn, can reduce the shunt current by a factor of 8 times, or more, depending on the length of the electrically-isolating fluid channels provided by the fluid-isolating insert.

FIG. 6A is an enlarged partial view of a pressure-balancing insert approach, where end plate assembly 110 includes a gap 610 between cathode-fluid-isolating insert 400 and end plate 120 that is in fluid communication with the fluid channels 401 through the assembly. In the depicted embodiment, the electrolyzer stack includes (in addition to the plurality of electrolyzer cells 101, current collector 300, and isolation plate 301) fluid channels 605 through current collector 300 and isolation plate 301 that are part of the cathode subsystem and are in fluid communication with electrically-isolating cathode fluid channels 401. In this pressure-balancing insert approach, a seal 620 (such as a fluidic seal that provides ionic isolation) is disposed, for instance, within a groove in at least one of the isolation plate 301 or the cathode-fluid-isolating insert 400, at an interface with isolation plate 301 and the insert within the electrolyzer stack. Advantageously, in the embodiment of FIG. 6A, cathode fluid fills gap 610 between cathode-fluid-isolating insert 400 and end plate 120, and in so doing, pressure balances on opposite sides of seal 620. By placing the seal in the short path between the current collector and the end plate, fluid passes over the top of the cathode-fluid-isolating insert within the pocket, and down the side of the fluid-isolating insert facing gap 610. This puts approximately the same fluid pressure on both sides of isolating seal 620, while maintaining full ionic isolation and a longer effective conduction path through the fluid between current collector 300 and end plate 120.

In one embodiment, an additional pressure seal 621 can be provided between isolation plate 301 and end plate 120. From a tolerance stack-up viewpoint, however, this is a two-way path seal similar to pressure seal 321 in the embodiments of FIGS. 3A-3C. Thus, in the embodiment of FIG. 6A, there are two types of seals, one seal 620 provides ionic isolation, with relatively little pressure differential across the seal, and the other provides full pressure differential rating between the end plate and isolation plate.

FIG. 6B depicts an alternate embodiment of end plate assembly 110, where cathode-fluid-isolating insert 400 is configured to withstand the full pressure of the fluid within fluid channels 401, 605 of the electrolyzer stack. In this case, seals 620, 622 on the bottom and top of the cathode-fluid-isolating insert provide pressure-sealing and ionic path sealing between the current collector and the end plate about the insert. This implementation can require machining or pocketing of the end plate, and precise installation of the seals 620, 622, to allow for the full-pressure rating of the seals. For instance, one or more grooves can be provided in the isolation plate 401, cathode-fluid-isolating insert 400, and/or end plate 120, to accommodate the pressure and ionic seals 620, 622, in one embodiment.

FIG. 6C depicts a further variation of the cathode-fluid-isolating insert 400 for end plate assembly 110 of the electrolyzer stack, in accordance with one or more aspects of the present invention. This embodiment illustrates a variation of the end plate assembly, where the pocket in the end plate 120, and/or the cathode-fluid-isolating insert 400, is sized and configured to facilitate inclusion of a conductive insert 630 of a secondary material, such as a solid, plated, or porous media, at the top of the cathode-fluid-isolating insert 400 within the pocket to facilitate controlling the reaction type that takes place along the fluid channel 401 wall within the assembly. As with the embodiment of FIG. 3C, shunt-to-ground current can pass through the cathode fluid path, which can lead to corrosion, pitting, dissolution, etc., of material at the top of the cathode-fluid-isolating insert within the pocket. The corrosion in turn can introduce ions into the fluid stream, which can be disadvantageous for conductivity of the fluid, and also cause localized pitting and corrosion points, which can lead to loss of sealing capability or lowered stress-handling capability. The conductive insert material can be selected to help control the type of reaction occurring at the end of the channels. In particular, the material for conductive insert 630 can be selected to drive the shunt current to cause a localized electrolysis reaction within the channels, which does not affect the end plate material at all, rather than a electrochemical reaction that may result in a dissolution of metal ions into the fluid stream. An example of the conductive material is platinum, with (in one embodiment), conductive insert 630 being coated with platinum to drive the localized electrolysis reaction within the fluid stream. As noted above, the conductive insert can be mechanically mounted in position any number of ways. For instance, the conductive insert can be press-fit into the end plate, or mechanically fastened to the end plate (e.g., via one or more bolts) in good electrical contact with the end plate.

Note that, although illustrated in association with the pressure-balanced, cathode-fluid-isolating insert approach of FIG. 6A, the conductive insert 630 of FIG. 6C approach can also be used in association with the full-pressure sealing approach of FIG. 6B.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. An electrolyzer system comprising:

a stack of at least one electrolyzer cell, the stack further including:

a current collector of the at least one electrolyzer cell;

an end plate assembly;

an isolation plate, the isolation plate being positioned between the end plate assembly and the current collector to electrically isolate the current collector from the end plate assembly; and wherein the end plate assembly includes at least one fluid channel to allow a fluid to pass through the end plate assembly, the at least one fluid channel being in fluid communication with at least one fluid channel through the current collector and the isolation plate, and wherein the end plate assembly comprises:

an end plate; and a fluid-isolating insert residing, at least in part, within a pocket in the end plate, the fluid-isolating insert including at least one electrically-isolating fluid channel that defines, at least in part, the at least one fluid channel of the end plate assembly, the fluid-isolating insert increasing an effective length of a fluid conduction path between the current collector and the end plate through the at least one fluid channel of the end plate assembly.

2. The electrolyzer system of claim 1, wherein the pocket in the end plate extends into the end plate from a surface of the end plate closest to the isolation plate.

3. The electrolyzer system of claim 2, further comprising a seal disposed, in part, within a groove in one of the isolation plate or the fluid-isolating insert at an interface of the isolation plate and fluid-isolating insert within the stack.

4. The electrolyzer system of claim 3, wherein a gap exists in the pocket between the fluid-isolating insert and the end plate, and the fluid fills the gap between the fluid-isolating insert and the end plate, which facilitates pressure-balancing opposite sides of the seal.

5. The electrolyzer system of claim 3, further comprising a pressure-containment seal disposed between the fluid-isolating insert and the end plate of the end plate assembly.

6. The electrolyzer system of claim 3, further comprising a conductive insert disposed between the fluid-isolating insert and the end plate within the pocket, the conductive insert defining, in part, the at least one fluid channel of the end plate assembly.

7. The electrolyzer system of claim 6, wherein the conductive insert comprises a platinum material which causes a localized electrolysis reaction at the conductive insert within the at least one fluid channel of the end plate assembly.

8. The electrolyzer system of claim 6, wherein a gap exists in the pocket between the fluid-isolating insert and the end plate, and the fluid fills the gap between the fluid-isolating insert and the end plate, which facilitates pressure-balancing opposite sides of the seal.

9. The electrolyzer system of claim 6, further comprising a pressure-containment seal disposed between the fluid-isolating insert and the end plate of the end plate assembly.

10. The electrolyzer system of claim 2, wherein the end plate assembly includes a plurality of fluid channels and manifold to allow the fluid to pass through the end plate assembly via the manifold of the end plate assembly, the plurality of fluid channels of the end plate assembly being in fluid communication with a plurality of fluid channels through the current collector and the isolation plate, and wherein the fluid-isolating insert includes a plurality of electrically-isolating fluid channels that define, at least in part, the plurality of fluid channels of the end plate assembly, the fluid-isolating insert increasing effective length of fluid conduction paths between the current collector and the end plate through the plurality of fluid channels of the end plate assembly.

11. The electrolyzer system of claim 2, wherein the end plate facilitates supplying a clamping force to the electrolyzer stack, and the fluid-isolating insert satisfies pressure containment restrictions within the electrolyzer stack.

* * * * *